United States Patent [19]

Tanaka

[11] 4,378,219

[45] Mar. 29, 1983

[54] OUTBOARD ENGINE

[75] Inventor: Kohya Tanaka, Narashino, Japan

[73] Assignee: Tanaka Kogyo Company Limited, Narashino, Japan

[21] Appl. No.: 259,557

[22] Filed: May 1, 1981

[30] Foreign Application Priority Data

Jul. 18, 1980 [JP] Japan ..... 55-100575[U]

[51] Int. Cl.[3] ..... B63H 21/28

[52] U.S. Cl. ..... 440/75; 192/48.7

[58] Field of Search ..... 440/86, 75; 192/105 CD, 192/48.7

[56] References Cited

U.S. PATENT DOCUMENTS

| | | | |
|---|---|---|---|
| 1,878,824 | 9/1932 | Dodge | 192/105 CD |
| 2,607,312 | 8/1952 | Johson | 440/75 |
| 2,888,721 | 5/1959 | Brueder | 192/105 CD |
| 3,092,230 | 3/1961 | Sisler | 192/105 CD |
| 4,016,964 | 4/1977 | Dietzsch et al. | 192/105 CD |

FOREIGN PATENT DOCUMENTS

| | | | |
|---|---|---|---|
| 1314103 | 11/1962 | France | 192/105 CD |

*Primary Examiner*—Trygve M. Blix
*Assistant Examiner*—Thomas J. Brahan
*Attorney, Agent, or Firm*—Frishauf, Holtz, Goodman & Woodward

[57] ABSTRACT

An outboard engine with an automatic clutch to be used for a fishing boat arranged between the crankshaft of the engine and the propeller driving shaft. The automatic clutch comprises a main centrifugal clutch mechanism which is to be engaged at a revolutional torque close to the rated revolution of the engine and an auxiliary centrifugal clutch mechanism which transmits the torque between the shafts with a frictional slip at a revolutional torque which is produced at a rate lower than the above mentioned one. For operating at a higher speed, the propeller is driven by the transmitted revolutional torque through the said main centrifugal clutch mechanism while for sailing at a slower speed or at trolling, it is driven by the torque which is reduced in transmission by the slip effect in the auxiliary centrifugal clutch mechanism.

5 Claims, 5 Drawing Figures

OUTBOARD ENGINE

BACKGROUND OF THE INVENTION

The present invention relates to an improvement of an outboard engine and, more particularly, to an improvement of a small to medium size outboard engine for use in fishing boats.

An outboard engine of small horsepower to be mounted on a fishing boat is generally required to be compact in size and light in weight for easier handling as well as to run at a high speed so as to arrive at the fishing area quickly. The outboard engine for fishing boats frequently used in rivers or lakes might be required, in addition to the above requisites, to sail the boat at such a low speed as 2 to 3 km per hour while trolling fishing lines behind thereof, or in other words, to move in what is called the trolling sail, depending on kinds of fish to be caught.

The outboard engine for fishing boats of the type mentioned above is often constructed as the direct-coupled type wherein the revolution of an engine is directly transmitted to a propeller without a clutch in order to build light weight engines. In such an outboard engine having a small horsepower as this, the revolution of the propeller generally is reduced to about one half of the revolution of a driving shaft. In the prior art outboard engine of the direct-coupled type, therefore, even when the engine is run at an idling rate of about 2,000 r.p.m. for the trolling sail, the revolution of the propeller becomes above 1,000 r.p.m. to make a boat as small as to accommodate two persons run at a speed higher than 4 km per hour, thereby presenting a problem when not running the boat at the low-speed trolling sail.

There has been known, another type of outboard engine which is provided with an automatic clutch, for instance a centrifugal clutch, between the crankshaft of the engine and the propeller driving shaft so as not to necessitate stopping of the engine even when the boat stands still. However, such conventional outboard engine with a clutch has drawbacks since the function of the clutch provided in the outboard engine mentioned above is so designed that it does not transmit the revolutional torque to the propeller driving shaft until the revolution of the engine reaches close to the rated revolution, for instance 3,500 r.p.m. During the idling operation period after starting the engine and before reaching near 3,500 r.p.m. in the engine of such a design, therefore, the centrifugal force on the clutch shoe is not sufficient to permit the engine revolution to be transmitted to the driving shaft. Generally, in a small engine of about 1 to 10 horsepower which is frequently utilized for a small boat built for two fishermen, when the centrifugal clutch mechanism reaches the "engaged" state at or around 3,500 r.p.m., the speed of the boat becomes 6 to 7 km per hour or higher. Accordingly, a boat, even if provided with a prior art centrifugal clutch in the outboard engine thereof, can not be run at a low-trolling speed simply by controlling a throttle thereof because the speed of the boat becomes too fast at a revolution which maintains the "engaged" state to allow the transmission to the propeller and if the revolution is further reduced to the "idling" state, the clutch becomes disengaged to cut completely the transmission to the propeller.

SUMMARY OF THE INVENTION

The main object of the present invention is to provide an outboard engine having an automatic clutch which can be operated simply by controlling a throttle lever of the engine both at a higher speed or at an engine revolution higher than the rated revolution and at a lower speed or at an engine idling revolution.

Another object of the present invention is to provide an outboard engine having dual-type automatic clutches which are convertible to the prior art centrifugal clutches for outboard engines of this type and which are structured so as to use the same parts as the conventional one.

One embodiment of the outboard engine according to the present invention comprises an internal combustion engine, a propeller, and an automatic clutch provided between a crankshaft of said engine and a driving shaft of the propeller, the automatic clutch being constructed integrally with a main centrifugal clutch mechanism which is engaged at a revolutional speed close to the rated revolution of the engine and an auxiliary centrifugal clutch mechanism which transmits the torque with a frictional sliding effect between said two shafts at a revolutional speed lower than the rated speed and at a slower idling speed. The main centrifugal clutch mechanism comprises, more particularly, a plural number of centrifugal clutch shoes which are journaled on the side surface of a supporting disc rotatable by the engine crankshaft and a clutch drum connected to the propeller driving shaft. When the revolution of the engine reaches close to the rated speed or revolution or 3,500 r.p.m., said centrifugal clutch shoes are connected to the clutch drum by a centrifugal force to transmit the revolutional torque of the engine crankshaft to the propeller driving shaft. The auxiliary centrifugal clutch mechanism comprises auxiliary centrifugal clutch shoes on the outer peripheral surface of the supporting disc which transmit the torque between both shafts with a frictional sliding effect caused by the friction against the clutch drum at a revolutional torque lower than that required for engaging the main centrifugal clutch, for instance at 2,000 r.p.m.

In the outboard engine according to the present invention, at a rate of engine revolution smaller than that required to engage the main centrifugal clutch mechanism, the auxiliary centrifugal clutch mechanism is made to transmit the engine revolutional torque to the propeller, but the mechanism hereby reduces the transmissive revolutional torque as well as speed before transmitting it to the propeller with frictional sliding. Accordingly at an idling rate of the engine revolution, the speed of the boat is made further slower, attaining a speed slower than that obtained by the said conventional direct-coupled type outboard engine at an idling revolutional rate, for instance, about one fourth of the conventional idling speed. Furthermore, within the engine revolutional speed range lower than that where the main centrifugal clutch gets in its "engaged" state, the auxiliary centrifugal clutch mechanism transmits the revolution torque increasingly with decreasing rate of slipping by a centrifugal force increase which is gained as the engine revolutional speed increases.

Therefore smooth propeller shaft torque as well as revolutional speed curve is obtained over the total engine revolutional speed range including the transitional range for the main centrifugal clutch mechanism to change from the "disengaged" to the "engaged" state.

Thereby, correlatively to the engine revolutional speed, any constant low boat speed is obtained or otherwise the trolling speed can be adjusted at the desired speed notwithstanding the speed and direction of water stream surrounding the area of boat.

The above mentioned objects and other objects of the present invention will be described in detail referring to a preferred embodiment and the appended drawings.

DESCRIPTION OF THE PREFERRED EMBODIMENT

Figure 1:
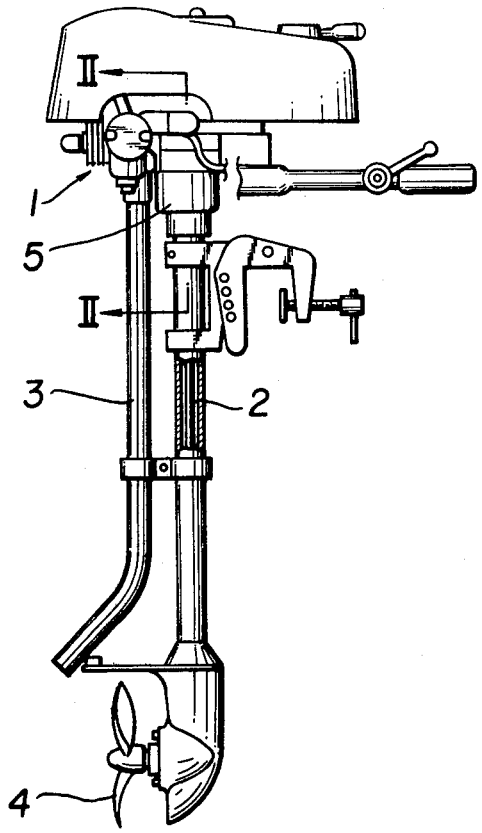
FIG. 1 is a side view to show the appearance of one embodiment of the present invention, FIG. 2 an enlarged view thereof seen from the arrow line II—II of FIG. 1, FIG. 3 a view of FIG. 2 seen from the arrow line III—III of FIG. 2, and FIG. 4 a view of FIG. 2 seen from the arrow line IV—IV of FIG. 2.

Describing an embodiment illustrated in the attached drawings according to the present invention, FIG. 1 illustrates a side view of the whole structure wherein the reference numeral 1 denotes an engine, 2 a propeller driving shaft, 3 an exhaust pipe and 4 a propeller which is connected to the driving shaft 3 via a reduction gear of 2 : 1 (not shown). An automatic clutch 5 is provided immediately below the engine 1.

Figure 2:
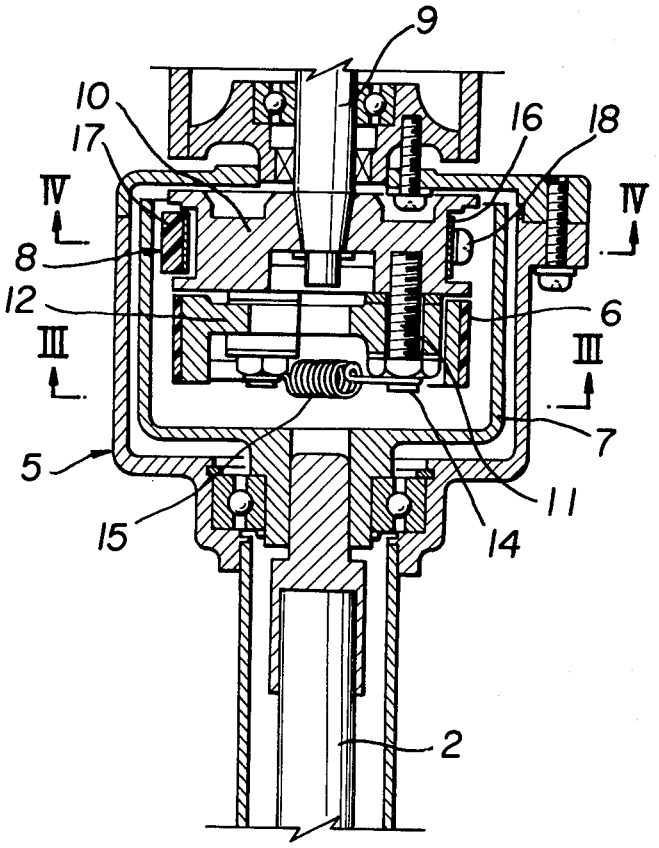

The clutch 5, as indicated in FIG. 2, comprises a dry-type centrifugal clutch mechanism wherein the clutch shoes 6 are made to open to closely contact with a clutch 7 by a centrifugal force when the revolution reaches a predetermined rate and also comprises auxiliary centrifugal clutch shoes 8 which are provided outside the clutch shoes 6 is adapted to slip with a friction force over the clutch drum 7 by a low revolutional torque of the engine, the clutch shoes 6 being the main clutch shoes.

Figure 3:
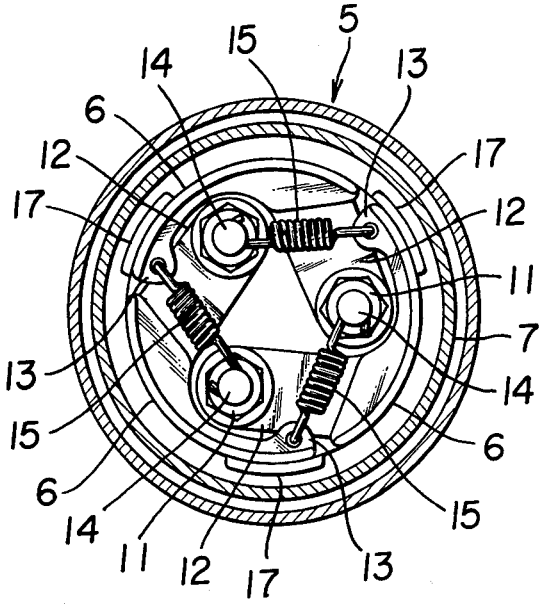
Figure 4:
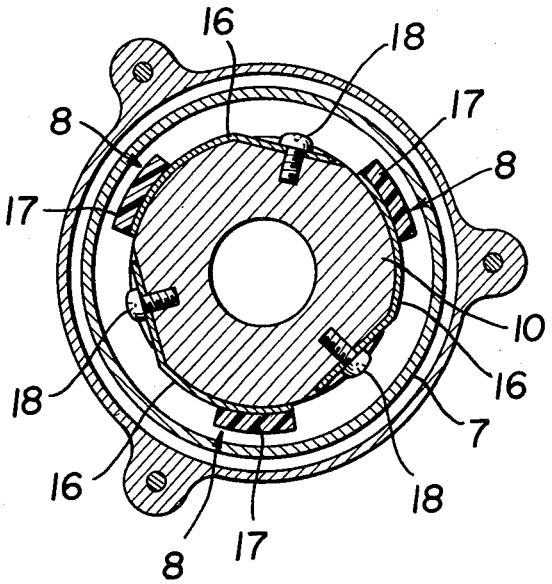

As indicated in FIG. 2, a supporting disc 10 is fixed on the lower end of the engine crankshaft 9 to support the main clutch shoes 6. The supporting disc 10 possess a diameter and a thickness sufficient to journal a plural number of main clutch shoes 6 on the lower surface thereof with bolts 11. The main clutch shoes 6 as illustrated in FIG. 3 comprise arc shaped shoes fixed on the ends of respective arms 12 of which tail ends are slidably engaged with bolts 11 to be supported on the supporting disc 10. Coil springs 15 are stretched respectively between a holding portion 13 on the inner surface of the shoe tip end and a pin 4 formed at the end of the bolt 11 on an adjacent main clutch shoe 6. Since the centrifugal force working upon respective shoes 6 exceeds the tensile force of the respective coil springs 15, when the engine revolution reaches close to the rated revolution, for instance 3,500 r.p.m., the main clutch shoes 6 are made to open outwardly to contact and engage with the inner surface of the clutch drum 7 located outside of the main clutch shoes 6. By closely contacting and engaging these main clutch shoes 6 with the clutch drum 7, the revolution of the crankshaft 9 is transmitted to a driving shaft 2 which is connected to the clutch drum 7. The upper surface of the clutch drum 7 extends to the outer periphery of the supporting disc 10 which supports the main clutch shoes 6.

As described hereinabove, a plural number of auxiliary centrifugal clutch shoes 8 are provided on the outer periphery of the supporting disc 10. These auxiliary clutch shoes 8 are made of, for instance, metal plate spring 16 of about 0.5 to 1.0 mm in thickness. Pads 17 are provided on the outer surfaces of the plate spring ends respectively, arranged on the outer periphery of the supporting disc 10 in a manner to extend in a longitudinal direction therearound. The rear ends of the plate springs are fixed respectively upon the supporting disc 10 with screws 18. The auxiliary clutch shoes 8 need not be limited to the above mentioned plate springs but may be chosen arbitrarily so far as to allow contact with and slipping over the drum 7 at a low revolutional torque.

Respective auxiliary clutch shoes 8 mentioned above are designed so that the outer surfaces of the pads 17 at the tip end thereof extend slightly over the outer surfaces of the main clutch shoes 6. Therefore, the cross section of the supporting disc 10 which fixes the auxiliary clutch shoes 8 is depressed at the portions which are fixed by the rear end screws of the plate springs 16.

Since an auxiliary centrifugal clutch mechanism 8 operable at a lower revolution torque is added to the main centrifugal clutch mechanism having the main clutch shoes 6 as mentioned above in the outboard engine according to the present invention, when the engine 1 is started and the revolution reaches around 2,000 r.p.m., the auxiliary clutch shoes 8 are first engaged by a centrifugal force to make the pads 17 contact with the inner surface of the clutch drum 7. At this stage, however, the engine revolution is not directly transmitted to the propeller 4 as described hereinafter. When the revolution increases and reaches close to 3,500 r.p.m., the main clutch shoes 6 are actuated by a centrifugal force to become closely contacted with the clutch drum 7 so as to directly transmit the engine revolution to the propeller driving shaft, whereby the propeller is made to rotate at a revolution which is one half of the engine revolution via the said reduction gear, making the boat sail to a fishing spot at a fast speed.

After arriving at the fishing spot, if the boat has to sail at a trolling rate, the throttle is closed in order to reduce the revolution of the engine to 2,000 to 2,800 r.p.m. Under such condition, the centrifugal force is too small to start the main clutch shoes 6 but large enough to start the auxiliary clutch shoes 8 as described hereinabove, thereby making the pads 17 contact with the inner surface of the clutch drum 7. The contact between the pads 17 and the clutch drum 7 still remains at this stage at a level to pull the plate springs 16 outward by the centrifugal force and not strong enough to securely engage with the clutch drum 7 and rotate the same. This condition can be expressed as a condition where the pads slide over the clutch drum 7. Due to this insufficient contact between the pads and the clutch drum 7, the revolution of the crankshaft 9 is largely reduced when transmitted to the clutch drum 7. Further, since the revolution of the propeller 4 is made one half of that of engine through the said reduction gear, the revolution of the propeller 4 becomes around 300 to 700 r.p.m., thereby enabling the boat to continuously sail at a trolling rate or at such low speed as 1 to 3 km per hour.

Figure 5:
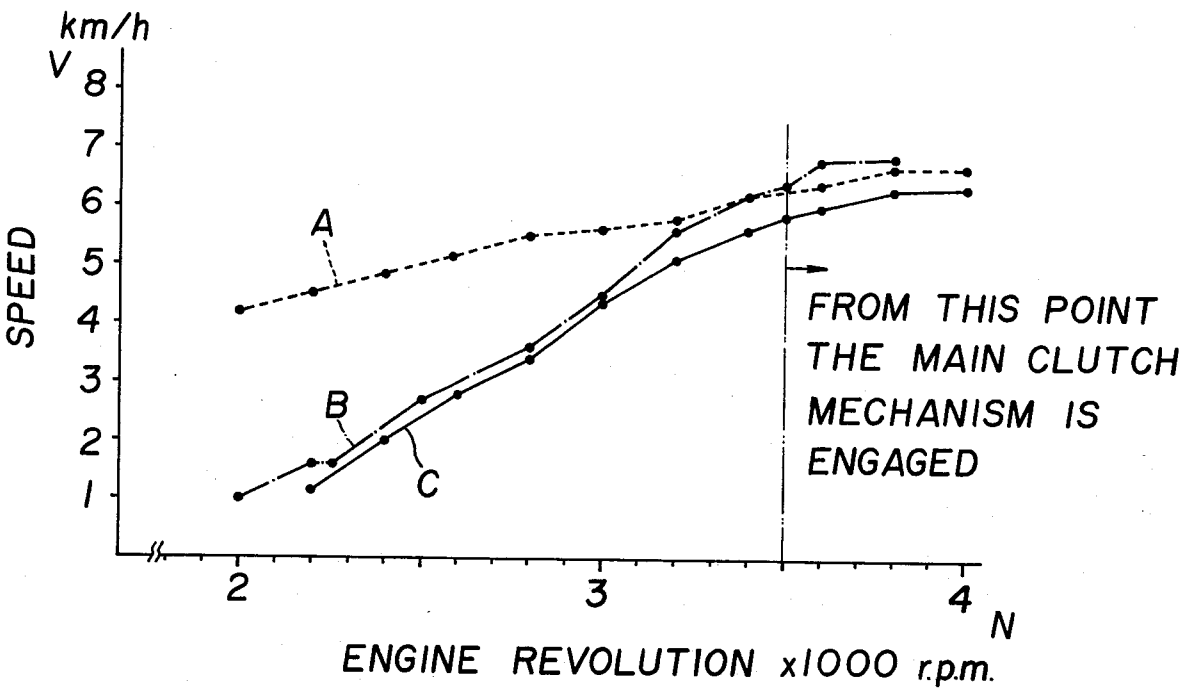
FIG. 5 is a graph to indicate the relation between the engine revolution N (axis of abscissas) and the speed of a boat V (axis of ordinate).

FIG. 5 is a graph to indicate the relation between the engine revolution and the speed of a boat at the idling rate for both the outboard engine according to the present invention and that of a conventional direct-coupling type outboard engine having no clutch. In the graph the letter A denotes the relation in the case of 2.5 horsepower outboard engine without a clutch, B denotes in the case of 3.0 horsepower engine having the multiple clutch mechanism according to the present invention and C the case of a 1.75 horsepower engine having a double clutch mechanism according to the present invention. A, B and C are measured under the same condition that two grown up persons are in a boat built for two passengers using an identical propeller.

As is obvious from the graph, in the case of a direct coupling type outboard engine indicated by the letter A, the boat can sail at the speed of 4.2 km/hr. at the idling rate of 2,000 r.p.m. while in the case of B the same boat can sail at the speed of 1 km/hr. at the same 2,000 idling rate, and at the speed of 2.6 km/hr. at the rate of 2,500 r.p m. In the case of C the boat can sail about 1.2 km/hr. at the rate of 2,200 r.p.m. and about the speed of 3.3 km/hr. at the rate of 2,800 r.p.m.

The outboard engine according to the present invention, therefore, is extremely advantageous in that a boat can be sailed automatically at an arbitrary slow speed simply by operating the engine at an idling rate or at a rate insufficient to engage the main clutch shoes 6.

What is claimed is:

1. In an outboard engine comprising an internal combustion engine having a crankshaft, a propeller on a driving shaft, and an automatic clutch provided between said crankshaft of said engine and said driving shaft of said propeller, the improvement wherein:

said automatic clutch comprises a main centrifugal clutch mechanism which is engaged at a revolutional speed close to the rated revolutional speed of the engine and an auxiliary centrifugal clutch mechanism which transmits the revolutional torque of said engine with a frictional slip between said crankshaft and said driving shaft at a revolutional speed of the engine lower than said rated revolutional speed or at an idling speed;

said main centrifugal clutch mechanism comprising a clutch drum coupled with said driving shaft of said propeller; a supporting disc mounted interior of said clutch drum and rotatably coupled with said crankshaft of said engine so as to rotate with said crankshaft; and a plurality of main centrifugal clutch shoes which are mounted on said supporting disc and which are engageable with said clutch drum by means of a centrifugal force acting thereon when the engine revolutional speed reaches close to said rated revolutional speed; and said auxiliary centrifugal clutch mechanism comprising a plurality of auxiliary centrifugal clutch shoes mounted on the outer periphery of said supporting disc and interior of said clutch drum; said respective auxiliary centrifugal clutch shoes each including a plate spring having a first end portion which is mounted on the outer periphery of said supporting disc, and a second end portion spaced from said first end portion; said auxiliary clutch shoes each further including a pad on the outer facing surface of said second end portion thereof and adapted to frictionally and slideably engage the inner surface of said clutch drum by means of a centrifugal force acting on said auxiliary clutch shoes at a revolutional speed of the engine lower than that required for engaging said main centrifugal clutch mechanism, the engagement pressure of said auxiliary clutch shoes against said clutch drum being a function of the amount of said centrifugal force, whereby the revolutional torque of said crankshaft is reduced by the resultant slip effect between said auxiliary clutch shoes and said clutch drum to transmit rotation to said propeller driving shaft at a lower speed than the revolutional speed of said crankshaft.

2. The outboard engine with automatic clutch of claim 1, further comprising a housing containing said main centrifugal clutch mechanism and said auxiliary centrifugal clutch mechanism, and for maintaining said clutch mechanisms in a dry state even when said engine is inserted to operate in water.

3. The outboard engine with automatic clutch of claim 1, wherein said main centrifugal clutch shoes are journaled on the end surface of said supporting disc.

4. The outboard engine with automatic clutch of claim 1, wherein said first end portions of said plate springs of said auxiliary centrifugal clutch shoes are each fixedly mounted to the outer periphery of said supporting disc.

5. The outboard engine with automatic clutch of claim 1, wherein said main centrifugal clutch shoes each include arc-shaped shoes which are fixed upon arms journaled at one end thereof on the end surface of said supporting disc by means of respective bolts, and coil springs extending between the ends of the respective arc-shaped shoes and the bolts of the other main centrifugal clutch shoes adjacent thereto.

* * * * *